US007629038B1

(12) United States Patent
Nishida et al.

(10) Patent No.: US 7,629,038 B1
(45) Date of Patent: Dec. 8, 2009

(54) PROCESS FOR PRODUCTION OF EASY-OPEN CAN LID MADE OF RESIN LAMINATED METAL SHEET, EASY-OPEN CAN LID, AND RESIN LAMINATED METAL SHEET FOR EASY-OPEN CAN LID

(75) Inventors: Hiroshi Nishida, Kitakyusyu (JP); Yashichi Oyagi, Kitakyusyu (JP); Kiyonori Nakamura, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 08/295,686

(22) PCT Filed: Dec. 24, 1993

(86) PCT No.: PCT/JP93/01878

§ 371 (c)(1),
(2), (4) Date: Aug. 24, 1994

(87) PCT Pub. No.: WO94/14552

PCT Pub. Date: Jul. 7, 1994

(30) Foreign Application Priority Data

Dec. 24, 1992 (JP) ..... 4-344312
Dec. 24, 1992 (JP) ..... 4-344313
Aug. 11, 1993 (JP) ..... 5-199614

(51) Int. Cl.
*B32B 15/09* (2006.01)
*C08J 5/18* (2006.01)

(52) U.S. Cl. ..... 428/172; 428/339; 428/458; 264/331.11

(58) Field of Classification Search ..... 428/45, 428/458, 622, 621
See application file for complete search history.

(56) References Cited

U.S. PATENT DOCUMENTS 3,832,963 A 9/1974 Gayner, et al.
4,887,732 A * 12/1989 Matsubayashi et al. ..... 220/278
5,131,556 A * 7/1992 Iioka et al. ..... 220/270
5,234,123 A * 8/1993 Layre et al. ..... 220/266
5,348,809 A * 9/1994 Oyagi et al. ..... 428/622

FOREIGN PATENT DOCUMENTS

JP 63-125152 AB 5/1988

* cited by examiner

*Primary Examiner*—Ramsey Zacharia
(74) *Attorney, Agent, or Firm*—Kenyon & Kenyon LLP

(57) ABSTRACT

A process for productive an easy-open can lid made of a resin laminated metal sheet comprising laminating a metal sheet or surface-treated metal sheet on one or both surfaces thereof with a crystalline saturated polyester resin film having a thickness of 10 to 100 μm, an elongation of at least 150%, a degree of crystallinity of not more than 10%, and a heat of fusion of crystalline of not less than 10 joules/g, to form a laminated metal sheet for an easy-open can, forming by a composite cold-forming method a tear-along grooves of a residual thickness of not more than ½ of the thickness of the material using top and bottom dies of a die radius of 0.1 to 1.0 mm, then heat treating the crystalline saturated polyester resin layer at the portion surrounding the tear-along groove at a temperature of at least the crystallization starting temperature and less than the melting point thereof and, also, an easy-open can lid obtained by the same and a resin laminated metal sheet used for the same.

9 Claims, 3 Drawing Sheets x100

PROCESS FOR PRODUCTION OF EASY-OPEN CAN LID MADE OF RESIN LAMINATED METAL SHEET, EASY-OPEN CAN LID, AND RESIN LAMINATED METAL SHEET FOR EASY-OPEN CAN LID

TECHNICAL FIELD

The present invention relates to a process for producing an easy-open can lid comprising a laminated metal sheet composed of a metal sheet such as a steel sheet, aluminum sheet, or a surface-treated metal sheet composed of such a metal sheet provided with surface treatment film or plastic lamination such as tin plating, a chromate film, a coating (painting), on which is laminated a specific crystalline saturated polyester resin film and which is provided with a tear-along groove for facilitating opening of the can and to a resin laminated metal sheet easy-open can lid obtained by the same and a resin laminated metal sheet for an easy-open can lid. The resin laminated metal sheet easy-open can lid according to the present invention is superior in ease of can opening, corrosion resistance, and feathering property and is suitable for use for canned drinks, general canned food, and other broad applications.

BACKGROUND ART

Among the easy-open cans used for canned drinks, general canned food, etc., there are the tear-off types where a tab consisting of part or all of the container lid is torn off by pulling and separated from the can body and the stay-on tab types where the tab remains attached to the can body. In these easy-open cans, coated aluminum sheet or steel sheet is used as the can opening material. This is punched out into the basic lid shape, then is placed on a flat bottom die and pressed down on by a top die on which is provided a sharp sectional edge scoring blade shaped to the contour of the tab so as to form a tab shaped tear-along groove with a V-sectional shape. To facilitate can opening, it was necessary to press-form the tear-along groove by the scoring blade so as to reach approximately ½ to ⅔ of the thickness of the sheet before processing. If the depth of the tear-along groove was too shallow, the ease of can opening would be poor, while if too deep, the strength would be insufficient and there would be problems in transport such as opening of the can due to even small external impact.

The can-opening materials are being made extremely thin due to the demands for ease of can opening. Therefore, considerable precision is being demanded for the scoring tools as well, and therefore, the problem has arisen of a significantly reduced tool life. To deal with this problem, measures have been devised to extend tool life such as with the "process for formation of a tear-off type tab for a can composed of forming a thin upward facing connection piece between the portions around the tab (tear-along bead groove) and the can body, then pushing down the tab so that the connection piece is bent at its intermediate portion to form a tear-along groove" such as in Japanese Unexamined Patent Publication (Kokai) No. 55-70434 or Japanese Unexamined Patent Publication (Kokai) No. 57-175034. Further, a can has been commercialized which is given repair coating for preventing the occurrence of rust at the portions of the metal surface exposed by the cutting of the surface treatment film by the processing to form the tear-along groove, but this repair coating, as in the main coating work, requires a complicated baking process which takes a long time and, further, there was the problem of contamination of the global environment by the carbon dioxide released from the solvent in which the coating is mixed at the time of baking.

In current day easy-open can lids, broad use is made of materials composed of aluminum or steel sheet coated with vinyl chloride organosol of a vinyl chloride coating composition, due to the advantages of processability, corrosion resistance, preservation of the flavor and taste of the contents, and price. On the other hand, however, there has been the problem that in the technology for recycling resources, when recovering used cans and incinerating or remelting them, vinyl chloride coating compositions give off toxic dioxin. In view of this problem, research and development efforts are underway on new coating composition which can take the place of such vinyl chloride composition.

Recently, to solve the above-mentioned problems and to eliminate the needs for repair coating of the tear-along groove portions, techniques have been developed for producing easy-open can lids where the tear-along groove portions are formed by press-forming the polyester resins laminated metal sheet by the die radius of top and bottom dies. In easy-open can lids, however, there has been the problem of a considerable amount of occurrence of feathering. The term "feathering" used herein means the organic film which is left at the edge portions of the cut opening on the can body side when the easy-open can lid is opened. This is disliked in that it gives an unsanitary image in the outer appearance. This sometimes was also a problem when opening cans formed with conventional easy-open can lids, that is, coated metal sheets formed with tear-along grooves by scoring the sectional surface with a sharp edge.

DISCLOSURE OF THE INVENTION

Accordingly, the object of the present invention is to provide a process for producing an easy-open can lid made of a resin laminated metal sheet which solves the problem of the usage life of the scoring tools caused by the easy-open can lid coated materials frequently used up to now, the environmental problem caused during the process for producing the coated material, the problem of feathering, and other various problems and also to provide an easy-open can lid obtained from the same.

Another object of the present invention is to provide a resin laminated metal sheet suitable for the production of the above-mentioned easy-open can lid.

In accordance with the present invention, there is provided a process for producing an easy-open can lid superior in feathering resistance made of a resin laminated metal sheet comprising laminating a metal sheet or surface-treated metal sheet on one or both surfaces thereof with a crystalline saturated polyester resin film having a thickness of 10 to 100 μm, an elongation of at least 150%, a crystallinity of not more than 10%, and a crystalline melting heat of not less than 10 joules/g to form a laminated metal sheet for an easy-open can, forming by a composite cold-forming method a tear-along groove of a residual thickness of not more than ½ of the thickness of the material using top and bottom dies of a die radius of 0.1 to 1.0 mm, then heat treating the crystalline saturated polyester resin layer at the portion surrounding the tear-along groove at a temperature of at least the crystallization starting temperature and less than the melting point.

In accordance with the present invention, there is also provided an easy-open can lid made of a resin laminated metal sheet having resin film properties of an elongation of not more than 100% and a degree of crystallinity of not less than 20% obtained by laminating a metal sheet or surface-treated metal sheet on one or both surfaces thereof with a crystalline saturated polyester resin film having a thickness of 10 to 100 μm, an elongation of at least 150%, a crystallinity of not more than 10%, and a heat of fusion of crystalline of not less than 10 joules/g to form a laminated metal sheet for an easy-open can, forming by a composite cold-forming method a tear-along groove of a residual thickness of not more than ½ of the thickness of the material using top and bottom dies of a die radius of 0.1 to 1.0 mm, then heat treating the crystalline saturated polyester resin layer at the portion surrounding the tear-along groove at a temperature of at least the crystallization starting temperature and less than the melting point.

In accordance with the present invention, there is further provided a plastic laminated metal sheet for an easy-open can lid comprising a metal sheet or surface-treated metal sheet laminated on one or both surfaces thereof with a crystalline saturated polyester resin film having a thickness of 10 to 100 μm, an elongation of at least 150%, a degree of crystallinity of not more than 10%, and a heat of fusion of crystalline of not less than 10 joules/g.

BRIEF DESCRIPTION OF THE DRAWINGS

The present invention will now be explained in further detail with reference to the drawings.

BEST MODE FOR CARRYING OUT THE INVENTION

Figure 1:
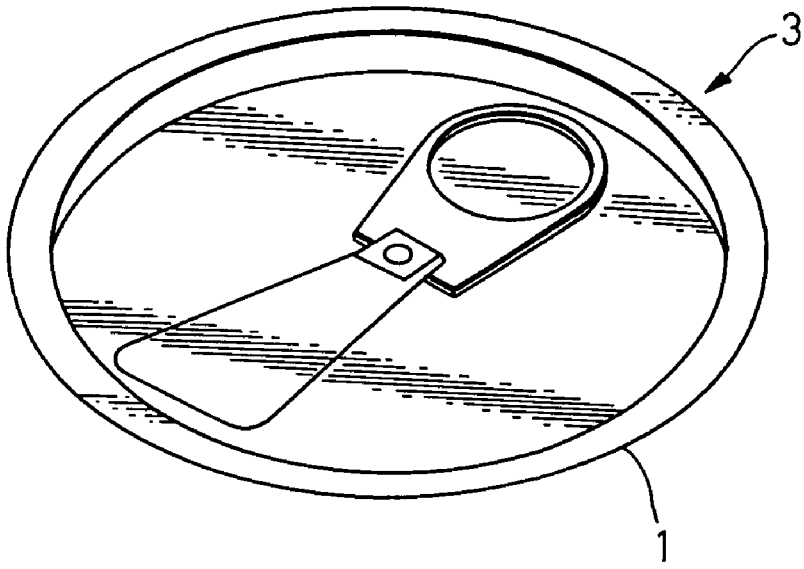
FIG. 1 is a perspective view of a can lid having a tear-off tab formed according to the present invention.

The present invention will be described in detail below.

The material used in the present invention is a conventionally used metal sheet or a surface-treated metal sheet composed of a metal sheet such as steel sheet provided on one or both surfaces thereof with one or more plating layers of a corrosion resistant metal such as Sn, Cr, Ni, Al, Zn and, further, a chromate treated film. More specifically, it includes a steel sheet or aluminum sheet and also a tin-plated steel sheet chemically treated to form an Sn coating weight of 0.5 to 3.0 g/m$^2$, a Sn/Ni plated steel sheet chemically treated to form an Ni coating weight of 0.01 to 0.5 g/m and an Sn coating weight of 0.5 to 2.0 g/m$^2$, an Nickel plated steel sheet chemically treated to form an Ni coating weight of 0.01 to 0.5 g/m$^2$, a chrome-chromate treated steel sheet usually called TFS (tin-free steel) provided with a 5 to 30 mg/m$^2$ Cr oxide layer on a 50 to 200 mg/m$^2$ metal Cr layer, etc.

Only naturally, it is possible to use a surface-treated metal sheet composed of an aluminum sheet subjected to electro chromate treatment or dip chromate treatment to provide it with a Cr oxide layer of an amount of deposition of chromium oxide of 3 to 50 mg/m$^2$ and a metal Cr layer of 10 to 200 mg/m$^2$. Further, sheet thicknesses of these materials and other conditions are not particularly limited, but in view of the suitability as a lid material, the sheet thickness is preferably 0.150 to 0.300 mm, more preferably 0.16 to 0.28 mm, and the elongation is 10 to 40%, more preferably 20 to 40%. Further, the hardness is not limited, but 54 to 68 is preferable.

One or both surfaces of the above-mentioned metal sheet or surface-treated metal sheet is laminated by a crystalline saturated polyester resin film having a thickness of 10 to 100 μm, preferably 10 to 80 μm, more preferably 16 to 60 μm, an elongation of at least 150%, preferably at least 200%, more preferably 250 to 800%, a degree of crystallinity of not more than 10%, preferably from 0 to 5%, and a heat of fusion of crystalline of not less than 10 joules/g, preferably 15 to 40 joules/g. This resin film has good adhesion and following of the substrate during the formation of the tear-along groove by the composite extrusion by the top and bottom dies having a predetermined die radius and the film itself has superior processability, and therefore, the material is completely covered even after the processing and there is no need for repair coating which had been needed in the past. Further, it is possible to produce an easy-open can lid which does not cause the problem of feathering during opening by performing a predetermined heat treatment after the formation of the tear-along groove.

The crystalline saturated polyester resin film used in the present invention is a linear thermoplastic polyester obtained by condensation polymerization of a dicarboxylic acid and a diol and is represented by polyethylene terephthalate. As the dicarboxylic acid component, there are terephthalic acid, isophthalic acid, phthalic acid, adipic acid, sebacic acid, azelaic acid, 2,6-naphthalene dicarboxylic acid, decanedicarboxylic acid, dodecanecarboxylic acid, cyclohexanedicarboxylic acid, and the like, which can be used alone or in mixtures. As the diol component, there are ethylene glycol, butane diol, decane diol, hexane diol, cyclohexane diol, neopentyl glycol, and the like, which can be used alone or in mixtures. Copolymers of two or more types of dicarboxylic acid components and two or more types of the diol components may be used, or copolymers with diethylene glycol, triethylene glycol, and the like and further with the other monomers or polymers may also be used.

Further, the above-mentioned polyester resins may be mixed with an ionomer, that is, a polymer of a structure of a copolymer of α-olefin such as ethylene and an unsaturated carboxylic acid such as acrylic acid or methacrylic acid, which is partially modified with zinc, sodium or another metal.

These resins may be mixed with, if necessary, a plasticizer, anti-oxidant, heat stabilizer, inorganic particles, pigments, organic lubricants, and other additives.

However, there are the following restrictions in the crystalline saturated polyester resin layer used in the present invention due to the object of the present invention. The thickness of the resin film is limited to 10 to 100 μm for the reason that with a film of a thickness of less than 10 μm, the barrier property (corrosion resistance and rust resistance) of the resin film layer is not secured, and therefore, the film has to be made thicker. On the other hand, with an excessive thickness of over 100 μm, the barrier property effect has reached the saturated zone, and therefore, there is an economical problem. Accordingly, considering the performance and economy, the thickness of the resin layer is preferably in the range of 10 to 80 μm, more preferably 16 to 60 μm. Further, due to stringent processing conditions, the elongation at break is desirably at least 150% to enable easy elongation and it is important that the crystallinity be not more than 10% as well. When the elongation at break is less than 150% and the degree of crystallinity is over 10%, the elongation becomes insufficient in the formation of the thin portion at the time of the later mentioned composite cold-forming, whereby numerous defects occur in the resin film. The elongation is more preferably at least 200%. Note that the elongation of the laminated resin film in the present invention is measured by the method in accordance with JIS (i.e., Japanese Industrial Standards) C2318 using plastic film peeled off from the substrate.

The degree of crystallinity in the present invention is the value measured by the following procedure:

(1) The X-ray diffraction strength of the resin film is measured in the range of 2θ=5 to 40.

(2) X-ray diffraction strength curves at 2θ=10 and 2θ=35 are connected by a straight line which is used as the base line.

(3) A resin identical to the resin layer is melted, then placed in liquid nitrogen or another means taken so as to obtain a sample considered to be substantially completely amorphous. This is then measured as to the X-ray diffraction strength under the same conditions as (1).

(4) The edges of the crystal diffraction peak of the diffraction strength line obtained in (1) are connected by a smooth curve. Note that the shape of the curve is made similar in form to the diffraction strength curve of the amorphous sample measured in (3).

(5) The area of the portion surrounded by the base line of (2) and the curve of (4) is made Ia and the area of the portion surrounded by the base line and the diffraction strength curve of (1) is made Ic.

(6) $\{Ic/Ia+Ic\}\times 100$ is used as the degree of crystallinity.

Further, it is important that the heat of fusion of crystalline of the laminated resin film used in the present invention be at least 10 joules/g. From the discoveries of the inventors made up to now, in the easy-open can lid obtained by the composite cold-forming mentioned later, at least the resin film on the inside of the can and the outer surface around the tear-along groove must be given a degree of crystallinity of at least 20%, preferably 20 to 40%, and an elongation of not more than 100%, preferably 40 to 80%, or else the problem of feathering at the time of can opening will occur. That is, when opening a can by pulling off a tab or pushing the tab in, when the resin film around the tear-along groove has a degree of crystallinity of less than 20% or an elongation of over 100%, broken pieces of the film will appear at the opening, which is unpleasant in appearance.

For processability at the time of the composite cold-forming, the resin film must have a low degree of crystallinity and a high degree of elongation. On the other hand, for feathering property, a high degree of crystallinity and low elongation are required, so there is a contradiction between the two.

Therefore, in the present invention, before the composite cold-forming, a film having a low degree of crystallinity and a high elongation is subjected to the composite cold-forming, then at least the plastic film inside the can and on its outer surface near the tear-along groove is heated to cause crystallization, thereby changing the physical properties to a high degree of crystallinity and a low elongation and as a resulting resolving the contradiction.

In other words, the present inventors engaged in various studies and as a result found that to heat a polyester resin film having physical properties of an elongation at break of not less than 150% and a degree of crystallinity of not more than 10% so as to efficiently modify the degree of crystallinity to not less than 20% and the elongation to not more than 100%, it is necessary that another of the physical properties of the resin film be a heat of fusion of crystalline of not less than 10 joules/g.

The heat of fusion of crystalline of the resin in the present invention means the value obtained by heating the resin in advance to the melting point of the resin +30° C., holding it there for 5 minutes to melt the same, then cooling to under 30° C. at a rate of temperature decrease of 10° C./min, measuring this as a sample by a differential scanning calorimeter (DSC) at a rate of temperature increase of 10° C./min, and finding the magnitude (area) of the peak of the melting of the crystal as the heat of fusion of crystalline (ΔHf). This heat of fusion of crystalline is expressed by joules/g. A large value thereof shows that the resin has a strong crystallinity. Note that the melting point used herein means the temperature giving the maximum endothermicity of the endothermic peak showing the fusion of crystalline obtained by measuring by a differential scanning calorimeter (DSC) at a rate of temperature increase of 10° C./min.

The can opening material laminated by the resin film in this way is processed as follows.

In forming the tear-along groove, a tear-along groove guaranteeing ease of opening without causing breakage of the resin film is formed by using top and bottom dies designed for forming a tear-along groove for making the tab shape and having a die radius of 0.1 to 1.0 mm, preferably 0.2 to 0.7 mm and subjecting the resin laminated material to composite extrusion to make the thickness of the metal at the thinnest portion not more than ½ of the thickness of the metal before processing.

When the die radius of the top and bottom dies for forming the tear-along groove is smaller than 0.1 mm, the portion of the die radius is sharp, so the laminated resin film of the processed material is damaged or broken during the processing. Further, when composite cold-forming is performed by a die radius over 1.0 mm, the material is subjected to composite cold-forming over more than necessary a portion and the adhesion between the metal and resin becomes poorer. Formation of more than required poor adhesion portions is a reason behind feathering. Further, poor adhesion portions of the coated film are not desirable from the viewpoint of corrosion resistance. The edges of the tab have to be subjected to composite cold-forming between the top and bottom dies so as to reach the desired thickness and the thinnest portion of the metal must be made not more than ½ of the thickness of the metal before processing, preferably not more than ⅓ of the same.

Further, in the present invention, after the formation of the tear-along groove and during the lid-making process or can-making process, heat treatment is performed in which the temperature of the resin film around the tear-along groove is made the crystallization starting temperature of the resin film to less than the melting point of the film. As explained above, to make the resin film of the laminated material follow the substrate during the press-forming, film properties of a low degree of crystallinity and a high elongation, that is, a degree of crystallinity of not more than 10% and an elongation of more than 150%, are required. On the other hand, to improve the feathering property at the time of can opening, it is necessary that the film properties be made a degree of crystallinity of not less than 20% and an elongation or not more than 100%.

Therefore, in the present invention, to secure these properties, heat treatment is performed. The heat treatment temperature has as its lower limit the crystallization starting temperature of the resin film so as to efficiently cause crystallization of the film and has as its upper limit the melting point temperature so as to prevent poor appearance due to melting and flowing of the resin film and heat degradation of the resin film. The heat treatment conditions must be selected for each type of thermoplastic resin used since the crystallization starting temperature and melting point differ with each thermoplastic resin used. These may be found by measuring the increase in temperature for a thermoplastic resin film by a differential scanning calorimeter at a rate of temperature rise of 10° C./min and assuming the crystallization starting temperature to be the rising edge of the peak of the crystallization. The melting point is the peak temperature at the time of fusion of crystallization.

Further, the method of heating is not particularly limited, but as examples mention may be made of heating in a heating furnace, heating by blowing hot air, heating directly by a burner flame, heating by infrared rays, heating from the metal plate of the substrate by induction heating, and contact with a heated solid.

Further, when performing the heat treatment in the middle of the lid-forming process, considering the processability of the resin film later, it is desirable to heat only the area near the tear-along groove.

In this series of processes, the resin film having the above properties is drawn uniformly together with the substrate and no processing defects occur at all, so there is no need for repair coating after the processing and it is possible to ensure excellent corrosion resistance. Further, according to the process of the present invention, the processing is based on extrusion, pushback, or other press molding processes using a die radius portion having smooth projecting curved surfaces, and therefore there is no problem with tool life as seen in the sharp edge press-forming system and therefore superior productivity is ensured. In addition, by performing heat treatment after the formation of the tear-along groove, it becomes possible to produce an easy-open can lid superior in feathering resistance.

Further, the present invention has as its main feature the optimization of the tear-along groove at the edges of the tab and can be applied to both the tear-off system where a handle and tab are torn off and separated from the can body and the stay-on tab system where the handle and the tab remain attached to the can body even after opening.

EXAMPLES

The present invention will now be further illustrated by, but is by no means limited to, the following Examples.

Example 1-1

The surface of a thin steel sheet having a sheet thickness of 0.250 mm and a hardness of 65 ($H_{R30-T}$) was subjected to electrical tin-plating for an amount of deposition of 2.8 g/m$^2$. The tin was heated and melted to give a surface having a mirror surface luster, then the sheet was subjected to electro chromate treatment in a treatment bath composed mainly of chromic acid to form a chromate film having 12 mg/m$^2$ of metal chrome and, on the top thereof, 12 mg/m$^2$ (as Cr) of chromium hydro oxide. The steel sheet was washed and dried, then was heated and, as shown in Table 1, was laminated on the both surfaces thereof with a resin film having a total thickness of 40 μm comprising a two-layer structure of polyester resins having different melting points, wherein the lower layer of No. 1 resin having 3% by weight of an ionomer (copolymer of ethylene and acrylic acid containing 5% of Zn) included therein, the upper layer had a thickness of 35 μm and the lower layer had a thickness of 5 μm, and the lower layer resin had a lower melting point than the upper layer and contained an ionomer. The degree of crystallinity of the laminated film was 4%. Further, the elongation of the film measured after peeling after lamination was 450%. The heat of fusion of crystalline of the resin film was 28 joules/g.

Figure 2:
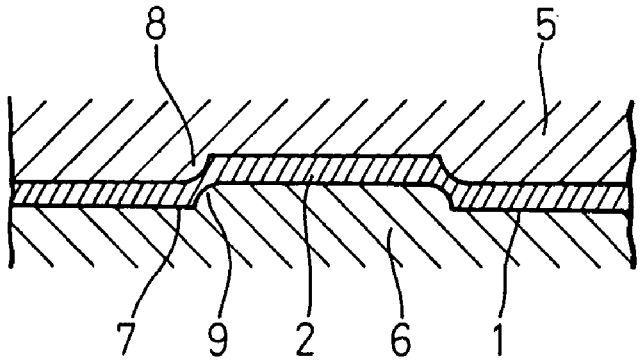
FIG. 2 is a longitudinal cross-sectional view showing the working manner of the present invention in the order of the step.

This steel sheet having polyester resin films on the both surfaces thereof was used to make an easy-open can lid as shown in FIG. 1. As shown in FIG. 2, top and bottom dies A 5 and 6 corresponding to the shape and dimensions of the tab and having a die radius of 0.5 mm were used to press the critical parts of the lid body for composite cold-forming so as to thereby extrude and form upward the portion corresponding to the tab 2.

At that time, the connection piece 7 connecting the tab 2 and the lid body 1 was processed by press-forming so as to form the thin portion having the smooth change in thickness.

Figure 3:
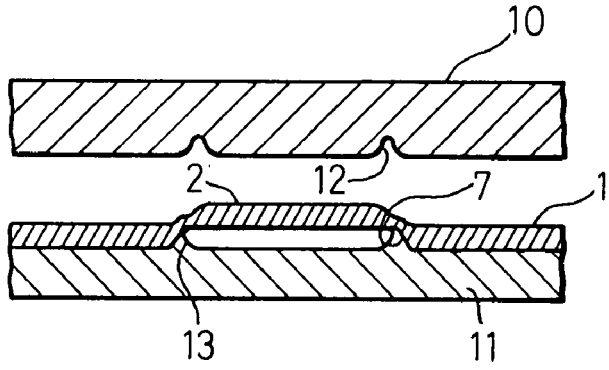
FIG. 3 is a longitudinal cross-sectional view showing the working manner of the present invention in the order of the step.

Next, as shown in FIG. 3, the lid body 1 was placed on the bottom die B 11 having a projecting portion 13 at the portion corresponding to the edges of the tab 2 and, as shown in the Figure, the top die B 10 having a groove 12 at a portion corresponding to the edges of the tab 2 was pressed down on it.

Figure 4:
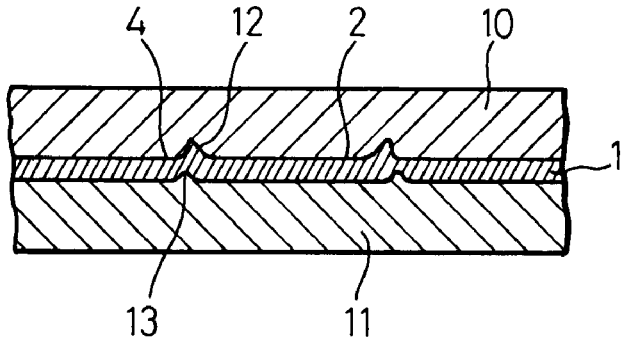
FIG. 4 is a longitudinal cross-sectional view showing the working manner of the present invention in the order of the step.

Due to this operation, as shown in FIG. 4, the connection piece 7 having a smooth change of thickness was bent downward in a V-shape from the approximately intermediate portion and entered into the groove 12. As a result, a thin tear-along line 4 forming a V-sectional shape was formed at the edges of the tab 2 at the bottom surface of the lid body 1.

The easy-open can lid thus formed was heat treated in a heating furnace at a resin film temperature of 140° C. for 2 minutes. Note that the thickness of the steel sheet of the thinnest portion in this Example was 48 μm. The resin film was formed in the same way as the steel sheet and the thickness remaining at the surface of the thinnest portion was about 8 μm on both sides. The degree of crystallinity of the resin film after heat treatment was 26% and the elongation was 87%. The heat treated easy-open can lid was subjected to evaluation of the ease of opening by measurement of the tear-off force of the tab and a measurement of the enamel rater value for determining the degree of damage of the resin film at the inside and outside of the can.

The ease of opening (force for lifting up handle and force for tearing off tab) was a superior one of not more than 1.7 kg and the conductance value of the resin film was 0.3 mA at the inside surface and 0.4 mA at the outside surface. Further, there was no visually noticeable feathering observable near the cut edge along the torn tear-along groove.

Example 1-2

The surface of a 5182 alloy H39 aluminum sheet having a sheet thickness of 0.280 mm was subjected to electro chromate treatment in a treatment bath composed mainly of chromic acid to form a chromate film having 12 mg/m$^2$ of metal chrome and, on the top thereof 12 mg/m$^2$ (as Cr) of chromium hydro oxide. The aluminum sheet was washed and dried, then was heated and was laminated on its two surfaces with a polyester resin film having a thickness of 16 μm (Composition: see No. 7 of Table 1) over a heat curing polyester adhesive (Composition: 70 parts by weight of a copolymerizable polyester resin "Vyron 200" and 30 parts by weight of a urethane resin "Coronate L"). The total thickness of the resin film was 16 μm. The degree of crystallinity of the laminated film was 2%. Further, the elongation of the film measured after peeling after lamination was 214%. The heat of fusion of crystalline of the resin film was 26 joules/g.

The resultant sheet having the resin film on the both surface thereof was press-formed as shown in FIG. 2 using the top and bottom dies A 5 and 6 having a die radius of 0.7 mm so as to extrude upward the portion corresponding to the tab 2.

At this time, the edges of the tab 2, the lid body 1, and the connection piece 7 were processed to form the thin portion having the smooth change of thickness by press-forming.

Figure 5:
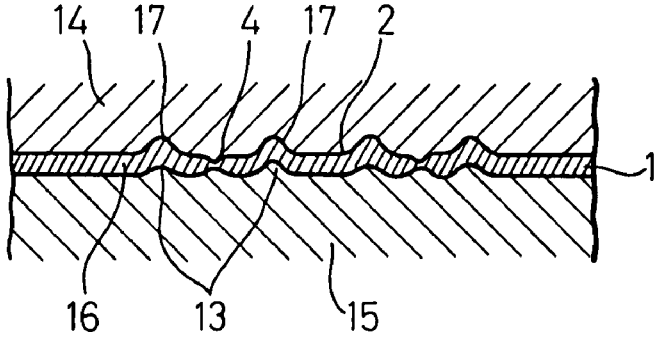
FIG. 5 is a longitudinal cross-sectional view showing the state of formation of a bead at the two sides of the tear-along groove.
Figure 6:
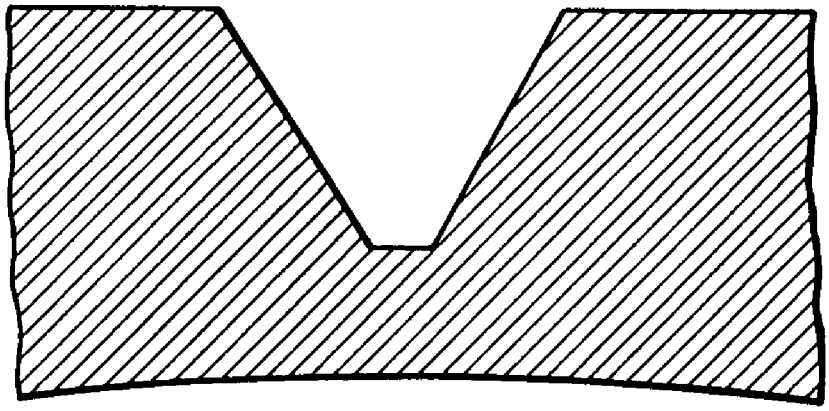
FIG. 6 is a cross-sectional view of a V-sectional shape tear-along groove formed by the conventional method of press-forming by a sharp edge.

Next, as shown in FIG. 5, the lid body 1 was placed, in a state inclined opening facing downward on the bottom die C 15 having a projecting portion 18 at the two sides of the portion corresponding to the edges of the tab 2 and pressed down on by the top die C 14 having the depressed portion 17 corresponding to the projecting portion 18 of the bottom die C 15.

Due to this operation, a bead was formed at the inside surface and the outside surface of the tear-along groove. With the exception of this bead portion, the lid body 1 and the tab 2 had the same height. At the edges of the tab 2 on the top surface of the body 1 was formed a thin tear-along line 4.

The easy-open can lid thus formed was heat treated by heating by hot air to a resin film temperature of 150° C. for 1 minute. Note that in the Example the thickness of the aluminum sheet of the thinnest portion was adjusted to 95 μm. The resin film was shaped in the same way as the aluminum sheet and the thickness remaining at the surface of the thinnest portion was about 5 μm on both sides. The degree of crystallinity of the resin films after heat treatment was 26% and the elongation was 55%. The heat-treated easy-open can lid was subjected to evaluation of the ease of opening by measurement of the tear-off force of the tab and a conductance test for determining the degree of damage of the resin film at the inside and outside of the can.

Regarding the ease of opening, the can was opened at not more than 1.7 kg without problem, and the conductance value of the resin film was 0.5 mA at the inside surface and 0.4 mA at the outside surface, sufficiently satisfactory for practical use. Further, there was no visually noticeable feathering observable near the cut edge along the torn tear-along groove.

Example 1-3

A steel sheet having a sheet thickness of 0.21 mm and a hardness of 61 ($H_{R30-T}$) which was subjected to electro treatment in a treatment bath comprising mainly chromic acid to give it 110 mg/m$^2$ of metal chrome and on top of that 15 mg/m$^2$ of chromium hydro oxide was used as a substrate and was laminated on both surfaces thereof with resin film having a total thickness of 24 μm comprising a two-layer structure of polyester resins having different melting points, wherein the upper layer (composition: see No. 3 of Table 1) had a thickness of 22 μm and the lower layer (composition: see No. 3 of Table 1) had a thickness of 2 μm and a lower melting point than the upper layer resin. The degree of crystallinity of the laminated film was 5%. Further, the elongation of the film measured after peeling after lamination was 320%. The degree of crystalline of the resin film was 16 joules/g.

This steel sheet having polyester resin film on the both surface thereof was used to make an easy-open can lid as shown in FIG. 1. As shown in FIG. 2, top and bottom dies A 5 and 6 corresponding to the shape and dimensions of the tab and having a die radius of 0.2 mm were used to press the critical parts of the lid body for composite cold-forming so as to thereby extrude and form upward the portion corresponding to the tab 2.

At that time, the connection piece 7 connecting the tab 2 and the lid body 1 was processed by press-forming so as to form the thin portion having the smooth change in thickness.

Next, as shown in FIG. 3, the lid body 1 was placed on the bottom die B 11 having a projecting portion 13 at the portion corresponding to the edges of the tab 2 and, as shown in the Figure, the top die B 10 having a groove 12 at a portion corresponding to the edges of the tab 2 was pressed down on it.

Due to this operation, as shown in FIG. 4, the connection piece 7 having a smooth change of thickness was bent downward in a V-shape from the approximately intermediate portion and entered into the groove 12. As a result, a thin tear-along line 4 forming a V-sectional shape was formed at the edges of the tab 2 at the bottom surface of the lid body 1.

The easy-open can lid thus formed was heat-treated in a heating furnace at a plastic film temperature of 140° C. for 2 minutes. Note that the thickness of the steel sheet of the thinnest portion in this Example was 55 μm. The resin film was shaped in the same way as the steel sheet and the thickness remaining at the surface of the thinnest portion was about 6 μm on both sides. The degree of crystallinity of the resin film after heat treatment was 24% and the elongation was 80%. The heat treated easy-open can lid was subjected to evaluation of the ease of opening by measurement of the tear-off force of the tab and a conductance test for determining the degree of damage of the resin film at the inside and outside of the can.

The ease of opening (force for lifting up handle and force for tearing off tab) was a superior one of not more than 1.8 kg and the conductance value of the resin film was 0.8 mA at the inside surface and 1.2 mA at the outside surface, which are sufficiently satisfactory for practical use. Further, there was no visually noticeable feathering observable by near the cut edge along the torn tear-along groove.

Comparative Example 1-1

The same plated steel sheet as in Example 1-1 was laminated on both the surfaces with a polyester resin film of a thickness of 8 μm (composition: see No. 7 of Table 1). The degree of crystallinity of the laminated film was 3%. Further, the elongation of the film measured after peeling after lamination was 256%. Also, the heat of fusion of crystalline was 26 joules/g.

This steel sheet having resin film on two surfaces thereof was subjected to the same processing and heat treatment as in Example 1-1 using the same dies as in Example 1-1.

In this Comparative Example, the thickness of the steel sheet at the thinnest portion was adjusted to 57 μm. The resin film was shaped in the same way as the steel sheet and the thickness of the resin film remaining at the surface of the thinnest portion was about 4 μm. The degree of crystallinity of the resin film after the heat treatment was 28% and the elongation was 71%.

Regarding the ease of can opening, the can was opened without problem with not more than 1.8 kg, but the conductance value of the film was 34 mA at the inside surface and 48 mA at the outside surface. There were considerable defects in the film and it was judged that the product lacked practical value.

Comparative Example 1-2

The same plated steel sheet as in Example 1-1 was laminated on both surfaces thereof with a two-layer structure of polyester resin films of different melting points, wherein the upper layer (composition: see No. 1 of Table 1) had a thickness of 35 μm, the lower layer (composition: see No. 1 of Table 1) had a thickness of 5 μm and a lower melting point than the upper layer resin, and the total thickness was 40 μm. The degree of crystallinity of the laminated film was 12%. Further, the elongation of the film measured after peeling after lamination was 170%. The heat of fusion of crystalline of the resin film was 28 joules/g.

This steel sheet having resin film on the two surfaces thereof was subjected to the same processing and heat treatment as in Example 1-1 using the same dies as in Example 1-1.

In this Comparative Example, the thickness of the steel sheet at the thinnest portion was adjusted to 57 μm. The resin film was shaped in the same way as the steel sheet and the thickness of the resin film remaining at the surface of the thinnest portion was about 9 μm. The degree of crystallinity of the resin film after the heat treatment was 34% and the elongation was 73%.

Regarding the ease of can opening, the can was opened without problem with not more than 1.8 kg, but the conductance value of the film was 54 mA at the inside surface and 68 mA at the outside surface and there were considerable defects in the film, so the product was judged practically usable, but the product was judged to lack practical value.

Comparative Example 1-3

The same plated steel sheet as in Example 1-1 was laminated on the both surfaces thereof with a two-layer structure of polyester resin films of different melting points, wherein the upper layer (composition: see No. 1 of Table 1) had a thickness of 35 μm, the lower layer (composition: see No. 1 of Table 1) had a thickness of 5 μm and a lower melting point than the upper layer resin, and the total thickness was 40 μm.

The degree of crystallinity of the laminated film was 9%. Further, the elongation of the film measured after peeling after lamination was 138%. The heat of fusion of crystalline of the resin film was 28 joules/g.

This steel sheet having resin film on the two surfaces thereof was subjected to the same processing and heat treatment as in Example 1-1 using the same dies as in Example 1-1.

In this Comparative Example, the thickness of the steel sheet at the thinnest portion was adjusted to 57 μm. The resin film was shaped in the same way as the steel sheet and the thickness of the resin film remaining at the surface of the thinnest portion was about 4 μm. The degree of crystallinity of the resin film after the heat treatment was 28% and the elongation was 75%.

Regarding the ease of can opening, the can was opened without problem with not more than 1.8 kg, but the conductance value of the film was 46 mA at the inside surface and 59 mA at the outside surface and there were considerable defects in the film, so the product was judged practically usable, but the product was judged to lack practical value.

Comparative Example 1-4

The same plated steel sheet as in Example 1-1 was laminated on the both surfaces thereof with a two-layer structure of polyester resin films of different melting points, wherein the upper layer (composition: see No. 4 of Table 1) had a thickness of 35 μm, the lower layer (composition: see No. 4 of Table 1) had a thickness of 5 μm and a lower melting point than the upper layer resin, and the total thickness was 40 μm. The degree of crystallinity of the laminated film was 2%. Further, the elongation of the film measured after peeling after lamination was 390%. The heat of fusion of crystalline of the resin film was 8 joules/g.

This steel sheet having resin film on the two surfaces thereof was subjected to the same processing and heat treatment as in Example 1-1 using the same dies as in Example 1-1, except that the heat treatment temperature was made 200° C. and the treatment time was made 1 minute.

In this Comparative Example, the thickness of the steel sheet at the thinnest portion was adjusted to 57 μm. The resin film was shaped in the same way as the steel sheet and the thickness of the resin film remaining at the surface of the thinnest portion was about 12 μm. The degree of crystallinity of the resin film after the heat treatment was 17% and the elongation was 79%.

Regarding the ease of can opening, the can was opened without problem with 1.8 kg or less, but the conductance value of the film at both the inside and outside surfaces was 0 mA and no film defects were observed at all, but there was tremendous residual film near the cut opening of the torn tear-along groove at the time of opening, which gave an unpleasant appearance and so problems remained in commercialization.

Example 2-1

The surface of a thin steel sheet having a sheet thickness of 0.250 mm and a hardness of 65 ($H_{R30-T}$) was subjected to electrolyzing treatment in a treatment bath comprised mainly of chromic acid to form a chromate film having 110 mg/m$^2$ of metal chrome and, on the top thereof, 15 mg/m$^2$ (as Cr) of chromium hydro oxide. The steel sheet was washed and dried, then was heated and was laminated on its two surfaces with a resin film having a total thickness of 40 μm comprising a two-layer structure of polyester resins having different melting points, wherein the upper layer (composition: see No. 1 of Table 1) had a thickness of 37 μm, the lower layer (composition: see No. 1 of Table 1) had a thickness of 3 μm, and the lower layer resin had a lower melting point than the upper layer resin and contained an ionomer. The elongation of the film measured after peeling after lamination was 450%, the degree of crystallinity was 2%, and the heat of fusion of crystalline of the resin film was 28 joules/g.

This steel sheet having polyester resin film on the two surfaces thereof was used to make an easy-open can lid as shown in FIG. 1. As shown in FIG. 2, top and bottom dies A5 and 6 corresponding to the shape and dimensions of the tab and having a die radius of 0.5 mm were used to press-form the critical parts of the lid body for composite cold-forming so as to thereby extrude and form upward the portion corresponding to the tab 2.

At that time, the connection piece 7 connecting the tab 2 and the lid body 1 was processed by press-forming so as to form the thin portion having the smooth change in thickness.

Next, as shown in FIG. 3, the lid body 1 was placed on the bottom die B 11 having a projecting portion 13 at the portion corresponding to the edges of the tab 2 and, as shown in the Figure, the top die B 10 having a groove 12 at a portion corresponding to the edges of the tab 2 was pressed down on it.

Due to this operation, as shown in FIG. 4, the connection piece 7 having a smooth change of thickness was bent downward in a V-shape from the approximately intermediate portion and entered into the groove 12. As a result, a thin tear-along line 4 forming a V-sectional shape was formed at the edges of the tab 2 at the bottom surface of the lid body 1.

The easy-open can lid thus formed was heat-treated in a heating furnace at a resin film temperature of 155° C. for 2 minutes. Note that the thickness of the steel sheet of the thinnest portion in this Example was 48 μm. The resin film was shaped in the same way as the steel sheet and the thickness remaining at the surface of the thinnest portion was about 8 μm on both sides. The degree of crystallinity of the resin film after heat treatment was 26% and the elongation was 87%. The heat treated easy-open can lid was subjected to evaluation of the ease of opening by measurement of the tear-off force of the tab and a conductance test for determining the degree of damage of the resin films at the inside and outside of the can.

The ease of opening (force for lifting up handle and force for tearing off tab) was a superior one of not more than 1.7 kg and the conductance value of the resin film was 0.3 mA at the inside surface and 0.4 mA at the outside surface. Further, there was no visually noticeable feathering observable near the cut edge along the torn tear-along groove.

Example 2-2

The same type of plated steel sheet as in Example 2-1 (however, having a sheet thickness of 0.21 mm and a hardness of 61) was laminated on the two surfaces thereof with a resin film having a total thickness of 24 μm comprising a two-layer structure of polyester resins having different melting points, wherein the upper layer (composition: see No. 2 of Table 1) had a thickness of 22 μm and the lower layer (composition: see No. 2 of Table 1) had a thickness of 2 μm and a lower melting point than the upper layer resins. The degree of crystallinity of the laminated films was 4%. The elongation of the film measured after peeling after lamination was 216%. Further, the heat of fusion of crystalline of the resin film was 25 joules/g.

This steel sheet having polyester resin films on the two surfaces thereof was extruded as shown in FIG. 2 using the top and bottom dies A 5 and 6 having the die radius of 0.4 mm so as to extrude and form upward the portion corresponding to the tab 2.

At that time, the edges of the tab 2, the lid body 1, and the connection piece 7 were processed by press-forming so as to form the thin portion having the smooth change in thickness.

Next, as shown in FIG. 5, the lid body 1 was placed, in a state inclined opening facing downward on the bottom die C 15 having a projecting portion 18 at the two sides of the portion corresponding to the edges of the tab 2 and pressed down on by the top die C 14 having the depressed portion 17 corresponding to the projecting portion 18 of the bottom die C 15.

Due to this operation, a bead was formed at the inside and the outside of the tear-along groove. With the exception of this bead portion, the lid body 1 and the tab 2 had the same height. At the edges of the tab 2 on the top surface of the body 1 was formed a thin tear-along line 4.

The easy-open can lid thus formed was heat-treated by heating by hot air to a resin film temperature of 170° C. for 20 seconds. Note that in this Example the thickness of the steel sheet of the thinnest portion was adjusted to 55 μm. The resin film was shaped in the same way as the steel sheet and the thickness remaining at the surface of the thinnest portion was about 6 μm on both sides. The degree of crystallinity of the resin film after heat treatment was 27% and the elongation was 86%. The heat treated easy-open can lid was subjected to evaluation of the ease of opening by measurement of the tear-off force of the tab and a conductance test for determining the degree of damage of the resin films at the inside and outside of the can.

Regarding the ease of opening, the can was opened at not more than 1.7 kg without problem, and the conductance value of the resin film was 0.6 mA at the inside surface and 0.5 mA at the outside surface, sufficiently satisfactory for practical use. Further, there was no visually noticeable feathering observable near the cut edge along the torn tear-along groove.

Example 2-3

The surface of an aluminum sheet having a sheet thickness of 0.280 mm was subjected to electro chromate treatment in a treatment bath composed mainly of chromic acid to form a chromate film having 12 mg/m$^2$ of metal chrome and, on the top thereof 12 mg/m$^2$ (as Cr) of chromium hydro oxide. The aluminum sheet was washed and dried, then was heated and was laminated on the two surfaces thereof with a resin film having a total thickness of 40 μm comprising a two-layer structure of polyester resins having different melting points, wherein the upper layer (composition: see No. 3 of Table 1) had a thickness of 38 μm, the lower layer (composition: see No. 3 of Table 1) had a thickness of 2 μm, and the lower layer had a lower melting point than the upper layer resin and contained an ionomer. The elongation of the film measured after peeling after lamination was 220%, the degree of crystallinity was 4%, and the heat of fusion of crystalline of the resin film was 16 joules/g.

This aluminum sheet having resin films on the two surfaces thereof was processed in the same way as in Example 2-1 using the top and bottom dies A 5 and 6 having a die radius of 0.6 mm.

The easy-open can lid thus formed was heat-treated in a heating furnace to a resin film temperature of 145° C. for 2 minutes. Note that in this Example the thickness of the aluminum sheet of the thinnest portion was adjusted to 95 μm. The resin film was shaped in the same way as the aluminum sheet and the thickness remaining at the surface of the thinnest portion was about 14 μm. The degree of crystallinity of the resin film after heat treatment was 30% and the elongation was 78%. The heat-treated easy-open can lid had an ease of opening enabling opening at not more than 1.7 kg with no problem and had a conductance value of the resin film of 0.3 mA at the inside surface and 0.3 mA at the outside surface, sufficiently satisfactory for practical use. Further, there was no visually noticeable feathering observable near the cut edge along the torn tear-along groove.

Comparative Example 2-1

The same plated steel sheet as in Example 2-1 was laminated on the both surfaces thereof with a resin film having a thickness of 9 μm made of a polyester resin (composition: see No. 6 of Table 1). The elongation of the film measured after peeling after lamination was 310%, the degree of crystallinity was 2%, and the heat of fusion of crystalline was 29 joules/g.

This steel sheet having resin film on the two surfaces thereof was subjected to the same processing and heat treatment as in Example 2-1 using the same dies as in Example 2-1.

In this Comparative Example, the thickness of the steel sheet at the thinnest portion was adjusted to 57 μm. The resin film was shaped in the same way as the steel sheet and the thickness of the resin film remaining at the surface of the thinnest portion was about 4 μm. The degree of crystallinity of the resin film after the heat treatment was 28% and the elongation was 70%.

Regarding the ease of can opening, the can was opened without problem with 1.8 kg or less, but the conductance value of the film was 66 mA at the inside surface and 43 mA at the outside surface. In a corrosion test using a solution of hydrochloric acid and ferrous chloride at the outside surface, perforation occurred at the thinnest portion and the product was judged not practically usable.

Comparative Example 2-2

The same plated steel sheet as in Example 2-1 was laminated on the both surfaces thereof with a two-layer structure of polyester resin films of different melting points, wherein the upper layer (composition: see No. 5 of Table 1) had a thickness of 37 μm, the lower layer (composition: see No. 5 of Table 1) had a thickness of 3 μm, the lower layer resin had a lower melting point than the upper layer resin and contained an ionomer, and the total thickness was 40 μm. The elongation of the film measured after peeling after lamination was 172%, the degree of crystallinity was 13%, and the heat of fusion of crystalline was 9 joules/g.

This steel sheet having resin film on the two surfaces thereof was subjected to the same processing and heat treatment as in Example 2-1 using the same dies.

In this Comparative Example, the thickness of the steel sheet at the thinnest portion was adjusted to 55 μm. The resin film was shaped in the same way as the steel sheet and the thicknesses of the resin film remaining at the surfaces of the thinnest portion were about 8 μm. The degree of crystallinity of the resin film after the heat treatment was 22% and the elongation was 116%.

Regarding the ease of can opening, the can was opened without problem with 1.8 kg or less, and the conductance value of the film was 0.2 mA at the inside surface and 0.4 mA at the outside surface, so the product was judged practically usable, but there was tremendous residual film near the cut opening of the torn tear-along groove at the time of opening, which gave an unpleasant appearance and so problems remained in commercialization.

Comparative Example 2-3

The same plated steel sheet as in Example 2-1 was laminated on the both surfaces thereof with a two-layer structure of polyester resin films of different melting points, wherein the upper layer (composition: see No. 4 of Table 1) had a thickness of 35 μm, the lower layer (composition: see No. 4 of Table 1) had a thickness of 5 μm and a lower melting point than the upper layer resin, and the total thickness was 40 μm. The elongation of the film measured after peeling after lamination was 261%, the degree of crystallinity was 4%, and the heat of fusion of crystalline was 8 joules/g.

This steel sheet having resin film on the two surfaces thereof was subjected to the same processing and heat treatment as in Example 2-1 using the same dies.

In this Comparative Example, the thickness of the steel sheet at the thinnest portion was adjusted to 56 μm. The resin film was shaped in the same way as the steel sheet and the thickness of the resin film remaining at the surface of the thinnest portion was about 7 μm. The degree of crystallinity of the resin film after the heat treatment was 14% and the elongation was 102%.

Regarding the ease of can opening, the can was opened without problem with 1.8 kg or less and the conductance value of the film was 0.6 mA at the inside surface and 0.4 mA at the outside surface, so the product was judged practically usable, but there was tremendous residual film near the cut opening of the torn tear-along groove at the time of opening, which gave an unpleasant appearance and so problems remained in commercialization.

Example 3-1

The surface of a thin steel sheet of a sheet thickness of 0.250 mm and a hardness of 65 ($H_{R30-T}$) was subjected to electrical tin-plating for an amount of deposition of 2.8 g/m$^2$. The tin was heated and melted to give a surface having a mirror surface luster, then the sheet was subjected to electro chromate treatment in a treatment bath composed mainly of chromic acid to form a chromate film having 12 mg/m$^2$ of metal chrome and, on the top thereof 12 mg/m$^2$ (as Cr) of chromium hydro oxide. The steel sheet was washed and dried, then was heated and was laminated on the two surfaces thereof with a resin film of a total thickness of 40 μm comprising a two-layer structure of polyester resin having different melting points, wherein the upper layer (composition: see No. 1 of Table 1) had a thickness of 35 μm, the lower layer (composition: see No. 1 of Table 1) had a thickness of 5 μm, and the lower layer resin had a lower melting point than the upper layer resin. The degree of crystallinity of the laminated film was 2%. The elongation of the film measured after peeling after lamination was 350%. The hear of fusion of crystalline of the resin film was 28 joules/g.

This steel sheet having polyester resin film on the two surfaces thereof was used to make an easy-open can lid (3) as shown in FIG. 1. As shown in FIG. 2, top and bottom dies A (5) and (6) corresponding to the shape and dimensions of the tab and having a die radius of 0.5 mm were used to press-form the critical parts of the lid body for composite cold-forming so as to thereby extrude and form upward the portion corresponding to the tab (2). At that time, the connection piece (7) connecting the tab (2) and the lid body (1) was processed by press-forming so as to form the thin portion having the smooth change in thickness.

Next, as shown in FIG. 3, the lid body (1) was placed on the bottom die B (11) having a projecting portion (13) corresponding to the center portion of the connection piece (7) and was pressed by the top die B (10) having a groove (12) corresponding to the projecting portion (13). Due to this operation, the connection piece (7) having a smooth change of thickness was bent downward in a V-shape from the approximately intermediate portion and entered into the groove (8). As a result, a thin tear-along line (4) forming a V-sectional shape was formed at the edges of the tab (2) at the bottom surface of the lid body (1).

The easy-open can lid thus formed was heat-treated in a heating furnace at a resin film temperature of 140° C. for 2 minutes. Note that the thickness of the steel sheet of the thinnest portion in this Example was 48 μm. The resin film was shaped in the same way as the steel sheet and the thickness remaining at the surface of the thinnest portion was about 8 μm on both sides. The degree of crystallinity of the resin film after heat treatment was 26% and the elongation was 67%. The heat treated easy-open can lid was subjected to evaluation of the ease of opening by measurement of the tear-off force of the tab and a conductance test for determining the degree of damage of the resin film at the inside and outside of the can. The ease of opening (force for lifting up handle and force for tearing off tab) was a superior one of not more than 1.7 kg and the conductance value of the resin film was 0.2 mA at the inside surface and 0.4 mA at the outside surface, which were sufficiently satisfactory for practical use. Further, there was no visually noticeable feathering observable near the cut edge along the torn tear-along groove.

Example 3-2

The surface of a 5182 alloy H39 aluminum sheet having a sheet thickness of 0.280 mm was subjected to electro chromate treatment in a treatment bath composed mainly of chromic acid to form a chromate film having 12 mg/m$^2$ of metal chrome and on top of that 12 mg/m$^2$ (as Cr) of chromium hydro oxide. The aluminum sheet was washed and dried, then was heated and was laminated on the two surfaces thereof with a polyester resin film of a total thickness of 16 μm comprising a two-layer structure of polyester resins having different melting points, wherein the upper layer (composition: see No. 3 of Table 1) had a thickness of 13 μm and the lower layer (composition: see No. 3 of Table 1) had a thickness of 3 μm and a lower melting point than the upper layer resin. The elongation of the laminated film was 320%, the degree of crystallinity was 4%, and the heat of fusion of crystalline was 16 joules/g.

This aluminum sheet having resin film on the two surfaces thereof was processed in the same way was as in Example 3-1 using the top and bottom dies A (5) and (6) having a die radius of 0.2 mm. In this Example, the thickness of the aluminum sheet of the thinnest portion was adjusted to 95 μm. The resin film was shaped in the same way as the steel sheet and the thickness remaining at the surface of the thinnest portion was about 7 μm on both sides. The easy-open can lid thus formed was clamped on to a can body and was heat treated by infrared rays to a film temperature of 205° C. for 20 seconds. The degree of crystallinity of the heat treated resin film was 32% and the elongation was 55%. Regarding the ease of opening, the can was opened with not more than 1.7 kg with no problem, and the conductance value of the resin films was 0.3 mA at the inside surface and 0.2 mA at the outside surface, sufficiently satisfactory for practical use. Further, there was no visually noticeable feathering observable near the cut edge along the torn tear-along groove.

Example 3-3

A steel sheet having a sheet thickness of 0.21 mm and a hardness of 61 ($H_{R30-T}$) which was subjected to electrolytic treatment in a treatment bath comprising mainly chromic acid to give it 110 mg/m$^2$ of metal chrome and, on the top thereof 15 mg/m$^2$ of chromium hydro oxide was used as a substrate and was laminated on both surfaces thereof with resin film having a total thickness of 30 μm comprising a two-layer structure of polyester resins having different melting points, wherein the upper layer (composition: see No. 2 of Table 1) had a thickness of 27 μm and the lower layer (composition: see No. 2 of Table 1) had a thickness of 3 μm and a lower melting point than the upper layer resin. The degree of crystallinity of the laminated film was 5%. Further, the elongation of the film measured after peeling after lamination was 370%.

The heat of fusion of crystalline of the resin film was 25 joules/g.

This steel sheet having resin film on the two surfaces thereof was used extruded as shown in FIG. 2 using the top and bottom dies A (5) and (6) of a die radius of 0.8 mm so as to extrude and form upward the portion corresponding to the tab (2).

At that time, the connection piece (7) connecting the tab (2) and the lid body (1) was processed by press-forming so as to form the thin portion having the smooth change in thickness.

Next, as shown in FIG. 5, the lid body (1) was placed, in a state inclined opening facing downward on the bottom die C (15) having a projecting portion (18) at the two sides of the portion corresponding to the inside and outside of the connection piece (7) and pressed down on by the top die C (14) having the depressed portion (17) corresponding to the projecting portion (18) of the bottom die C (15).

Due to this operation, a bead was formed at the inside and the outside of the tear-along groove. With the exception of this bead portion, the lid body (1) and the tab (2) had the same height. At the edges of the tab (2) on the top surface of the body (1) was formed a thin tear-along line (4). After this, the area near the tear-along line was heat treated by infrared rays at a resin film temperature of 170° C. for 1 minute to form a rivet.

Note that in this Example, the thickness of the steel sheet of the thinnest portion was adjusted to 55 μm. The resin film was shaped in the same way as the steel sheet and the thickness remaining at the surface of the thinnest portion was about 6 μm on both sides. The degree of crystallinity of the resin film after heat treatment was 26% and the elongation was 70%. The heat-treated easy-open can lid was subjected to evaluation of the ease of opening by measurement of the tear-off force of the tab and a conductance test for determining the degree of damage of the resin film at the inside and outside of the can.

Regarding the ease of opening, the can was opened at not more than 1.8 kg without problem, and the conductance value of the resin films was 0.3 mA at the inside surface and 0.3 mA at the outside surface, sufficiently satisfactory for practical use. Further, there was no visually noticeable feathering observable near the cut edge along the torn tear-along groove.

Comparative Example 3-1

The same plated steel sheet as in Example 3-1 was laminated on the both surfaces thereof with two-layer structures of polyester resins having different melting points, wherein the upper layer (composition: see No. 1 of Table 1) had a thickness of 35 μm, the lower layer (composition: see No. 1 of Table 1) had a thickness of 5 μm, the lower layer resin had a lower melting point than the upper layer resin, and the total thicknesses were 40 μm. The degree of crystallinity of the laminated film was 2% and the heat of fusion of crystalline was 28 joules/g. The elongation of the film measured after peeling after lamination was 350%.

This steel sheet having resin film on the two surfaces thereof was subjected to the same processing and heat treatment as in Example 3-1 using top and bottom dies A (5) and (6) of a die radius of 0.08 mm. In the comparative example, the thickness of the steel sheet at the thinnest portion was adjusted to 48 μm. The thicknesses of the resin film remaining at the surfaces of the thinnest portion was 8 μm on both surfaces. The degree of crystallinity of the resin film after the heat treatment was 26% and the elongation was 67%.

Regarding the ease of can opening, the can was opened without problem with not more than 1.7 kg, but the conductance value of the resin film was 105 mA at the inside surface and 95 mA at the outside surface—both extremely large values. Numerous defects were observed in the resin film at the tear-along portion. Even with an overly small die radius, a practically usable product could not be obtained.

Comparative Example 3-2

The same chromate film treated aluminum sheet as in Example 3-2 was laminated on the both surfaces thereof with a two-layer structure of polyester resins having different melting points, wherein the upper layer (composition: see No. 3 of Table 1) had a thickness of 13 μm, the lower layer (composition: see No. 3 of Table 1) had a thickness of 3 μm, the lower layer resin had a lower melting point than the upper layer resin, and the total thickness was 16 μm. The degree of crystallinity of the laminated film was 2%. The elongation of the film measured after peeling after lamination was 250% and the heat of fusion of crystalline was 16 joules/g.

This aluminum sheet having resin film on the two surfaces thereof was subjected to the same processing and heat treatment as in Example 3-2 using top and bottom dies A (5) and (6) of a die radius of 1.2 mm. In the Comparative Example, the thickness of the aluminum sheet at the thinnest portion was adjusted to 95 μm. The resin film was shaped in the same way as the steel sheet and the thickness remaining at the surface of the thinnest portion was about 7 μm. The degree of crystallinity of the resin film after the heat treatment was 32% and the elongation was 55%.

The ease of can opening was a superior one of not more than 1.8 kg and the conductance value of the resin film was 1.2 mA at the inside surface and 1.4 mA at the outside surface, so the product was judged to be practical, but there was tremendous residual film near the torn edges of the tear-along groove torn at the time of open, which gave an unpleasant appearance. Even if the die radius is overly large, problems remain in commercial usage.

Comparative Example 3-3

The same plated steel sheet as in Example 3-1 was laminated on both surfaces with polyester resin film (composition: see No. 6 of Table 1) of a thickness of 8 μm. The degree of crystallinity of the laminated film was 2%. Further, the elongation of the film measured after peeling after lamination was 270%, and the heat of fusion of crystalline was 28 joules/g.

This steel sheet having resin film on the two surfaces thereof was subjected to the same processing and heat treatment as in Example 3-1 using the same dies as in Example 3-1. In this Comparative Example, the thickness of the steel sheet at the thinnest portion was adjusted to 46 μm. The degree of crystallinity of the resin film after the heat treatment was 26% and the elongation was 60%. Regarding the ease of can opening, the can was opened without problem with not more than 1.8 kg, the conductance value of the resin film was 102 mA at the inside surface and 112 mA at the outside surface—both extremely large values. Numerous defects were observed in the resin film at the tear-along portion. The product could not be used commercially.

Comparative Example 3-4

The same plated steel sheet as in Example 3-1 was laminated on the both surfaces thereof with a two-layer structure of polyester resins having different melting points, wherein the upper layer (composition: see No. 1 of Table 1) had a thickness of 35 μm, the lower layer (composition: see No. 1 of Table 1) had a thickness of 5 μm and a lower melting point than the upper layer resin, and the total thickness was 40 μm. The degree of crystallinity of the laminated film was 9%. The elongation of the film measured after peeling after lamination was 120% and the heat of fusion of crystalline was 28 joules/ g. This steel sheet having resin film on the two surfaces thereof was subjected to the same processing and heat treatment as in Example 3-1 using the same dies as in Example 3-1.

In this Comparative Example, the thickness of the steel sheet at the thinnest portion was adjusted to 50 μm. The resin film was shaped in the same way as the steel sheet and the thickness remaining at the surface of the thinnest portion was about 8 μm. The degree of crystallinity of the resin film after the heat treatment was 26% and the elongation was 60%.

Regarding the ease of can opening, the can was opened without problem with not more than 1.8 kg, but the conductance value of the resin film was 54 mA at the inside surface and 68 mA at the outside surface and there were considerable defects in the resin film. It was judged that the product lacked commercial value.

Comparative Example 3-5

The same plated steel sheet as in Example 3-1 was laminated on the both surfaces thereof with a two-layer structure of polyester resins having different melting points, wherein the upper layer (composition: see No. 1 of Table 1) had a thickness of 35 μm, the lower layer (composition: see No. 1 of Table 1) had a thickness of 5 μm and a lower melting point than the upper layer, and the total thickness was 40 μm. The degree of crystallinity of the laminated film was 12%. The elongation of the film measured after peeling after lamination was 170% and the heat of fusion of crystalline was 28 joules/g.

This steel sheet having resin film on the two surfaces thereof was subjected to the same processing as in Example 3-1 using the same dies as in Example 3-1. In this Comparative Example, the thickness of the steel sheet at the thinnest portion was adjusted to 50 μm. The thickness of the resin film remaining at the surfaces of the thinnest portion was about 7 μm. The degree of crystallinity of the resin film after the heat treatment was 28% and the elongation was 75%.

Regarding the ease of can opening, the can was opened without problem with not more than 1.7 kg, but the conductance value of the resin film was 104 mA at the inside surface and 98.9 mA at the outside surface—both extremely large values. Numerous defects were observed in the resin film at the tear-along portion. The product was not commercially usable.

Comparative Example 3-6

The same plated steel sheet as in Example 3-1 was laminated on the both surfaces thereof with a two-layer structure of polyester resins having different melting points, wherein the upper layer (composition: see No. 4 of Table 1) had a thickness of 35 μm, the lower layer (composition: see No. 4 of Table 1) had a thickness of 5 μm and a lower melting point than the upper layer resin, and the total thickness was 40 μm. The degree of crystallinity of the laminated film was 3%. The elongation of the film measured after peeling after lamination was 318%. Further, the heat of fusion of crystalline of the resin film was 8 joules/g.

This steel sheet having resin film on the two surfaces thereof was subjected to the same processing and heat treatment as in Example 3-1 using the same dies as in Example 3-1.

In this Comparative Example, the thickness of the steel sheet at the thinnest portion was adjusted to 48 μm. The resin film was shaped in the same way as the steel sheet and the thickness of the resin film remaining at the surface of the thinnest portion was about 7 μm. The degree of crystallinity of the resin film after the heat treatment was 15% and the elongation was 140%.

Regarding the ease of can opening, the can was opened without problem with not more than 1.8 kg and the conductance value of the film was 0.2 mA at both the inside and outside surface, levels of no practical problem, but there was tremendous residual film near the cut opening of the torn tear-along groove at the time of opening, which gave an unpleasant appearance and so problems remained in commercialization.

Comparative Example 3-7

The same laminated steel sheet as in Example 3-1 was subjected to the same processing as in Example 3-1 using the same dies as in Example 3-1 and was subjected to 10 minutes of heat treatment in a heating furnace so that the film temperature became 90° C.

In this Comparative Example, the thickness of the steel sheet at the thinnest portion was adjusted to 48 μm. The resin film was shaped in the same way as the steel sheet and the thickness remaining at the surface of the thinnest portion was about 8 μm. The degree of crystallinity of the resin film after the heat treatment was 2% and the elongation was 327%.

Regarding the ease of can opening, the can was opened without problem with not more than 1.7 kg and the conductance value of the film was 0.3 mA at both the inside and outside surfaces thereof, which is a level of no practical problem, but there was tremendous residual film near the opening along the tear-along groove torn along at the time of opening, which had an unpleasant appearance and so a problem remained with commercialization.

Comparative Example 3-8

The same laminated steel sheet as in Example 3-1 was subjected to the same processing as in Example 3-1 using the same dies as in Example 3-1 and was subjected to 10 seconds of heat treatment by heating by hot air so that the film temperature became 250° C.

In this Comparative Example, the thickness of the steel sheet at the thinnest portion was adjusted to 48 μm. The resin film was shaped in the same way as the steel sheet and the thickness remaining at the surface of the thinnest portion was about 8 μm. The degree of crystallinity of the resin film after the heat treatment was 42% and the elongation was 27%.

Regarding the ease of can opening, the can was opened without problem with not more than 1.7 kg, but the portion of the film heated by the hot air was tinged yellow and so a problem remained with commercialization.

TABLE 1

| Polyester resin No. | Composition of polyester resin component: Acid component: Tere-phthalic acid | Iso-phthalic acid | Adipic acid | Glycol component: Ethylene glycol | 1-4-butane diol | Physical properties: Melting point Tm (° C.) | Crystallization starting temperature Tcs (° C.) |
|---|---|---|---|---|---|---|---|
| No. 1 | | | | | | | |
| Upper layer | 89 | 11 | — | 100 | — | 230 | 110 |
| Lower layer | 75 | 25 | — | 100 | — | — | — |
| No. 2 | | | | | | | |
| Upper layer | 85 | 15 | — | 100 | — | 225 | 105 |
| Lower layer | 73 | 27 | — | — | — | — | — |
| No. 3 | | | | | | | |
| Upper layer | 77 | 22 | 1 | 100 | — | 220 | 100 |
| Lower layer | 59 | 40 | 1 | 100 | — | — | — |
| No. 4 | | | | | | | |
| Upper layer | 74 | 23 | 3 | 80 | 20 | 220 | 100 |
| Lower layer | 57 | 40 | 3 | 80 | 20 | — | — |
| No. 5 | | | | | | | |
| Upper layer | 74 | 16 | 10 | 80 | 20 | 220 | 100 |
| Lower layer | 60 | 35 | 5 | 80 | 20 | — | — |
| No. 6 single layer | 89 | 11 | — | 100 | — | 231 | 111 |
| No. 7 single layer | 85 | 15 | — | 100 | — | 226 | 106 |

INDUSTRIAL APPLICABILITY

As explained above, the process for producing an easy-open can lid according to the present invention adopts the method of using a material obtained by laminating a resin film on a steel sheet or aluminum and forming a tear-along groove by the method of forming a thin portion by pressing without the use of a sharp edge, so completely eliminates all coating in the manufacturing process and therefore eliminates all of the big problems in the prior art, that is, the problem of the usage life of the cutting tools, unease over corrosion resistance, etc.

Further, it becomes possible to produce an easy-open can lid with a good feathering resistance by heat treating the tear-along groove after its formation.

In particular, by commercialization of a steel easy-open can lid, a "monometal can" becomes possible, and therefore, it becomes possible to supply to the market products suited for recycling and thereby help contribute to protection of the global environment. Of course, steel sheet itself is economically superior and by making both the can body and can lid out of steel sheet, products which are economically more superior and are easy to recycle as resources can be expected.

The invention claimed is:

1. A process for producing an easy-open can lid made of a resin laminated metal sheet comprising laminating a metal sheet or surface-treated metal sheet on one or both resin surfaces thereof with a crystalline saturated polyester resin film having a thickness of 10 to 100 μm, an elongation of at least 150%, a degree of crystallinity of not more than 10%, and a heat of fusion of crystalline of not less than 10 joules/g, to form a laminated metal sheet for an easy-open can, forming by a composite cold-forming method a tear-along groove of a residual thickness of not more than ½ of the thickness of the material using top and bottom dies of a die radius of 0.1 to 1.0 mm, then heat treating the crystalline saturated polyester resin layer at the portion surrounding the tear-along groove at a temperature of at least the crystallization starting temperature and less than the melting point thereof.

2. A process for production as claimed in claim 1, wherein the thickness of the resin film laminated on the metal sheet or surface-treated metal sheet is 10 to 80 μm.

3. A process for production as claimed in claim 1, wherein the thickness of the resin film laminated on the metal sheet or surface-treated metal sheet is 16 to 60 μm.

4. A process for producing an easy-open can lid made of a resin laminated metal sheet as claimed in any one of claim 1, wherein the elongation of the resin film laminated on the metal sheet or surface-treated metal sheet is at least 200%.

5. An easy-open can lid made of a resin laminated metal sheet having resin film properties of an elongation of not more than 100% and a degree of crystallinity of not less than 20% obtained by laminating a metal sheet or surface-treated metal sheet on one or both surfaces thereof with a crystalline saturated polyester resin film having a thickness of 10 to 100 μm, an elongation of at least 150%, a degree of crystallinity of not more than 10%, and a heat of fusion of crystalline of not less than 10 joules/g to form a laminated metal sheet for an easy-open can, forming by a composite cold-forming method a tear-along groove of a residual thickness of not more than ½ of the thickness of the material using top and bottom dies of a die radius of 0.1 to 1.0 mm, then heat treating the crystalline saturated polyester resin layer at the portion surrounding the tear-along groove at a temperature of at least the crystallization starting temperature and less than the melting point thereof.

6. An easy-open can lid made of a resin laminated metal sheet as claimed in claim 5, wherein the thickness of the resin film laminated on the metal sheet or surface-treated metal sheet is 10 to 80 μm.

7. An easy-open can lid made of a resin laminated metal sheet as claimed in claim 5, wherein the thickness of the resin film laminated on the metal sheet or surface-treated metal sheet is 16 to 60 μm.

8. An easy-open can lid made of a resin laminated metal sheet as claimed in any one of claim 5, wherein the elongation of the resin film laminated on the metal sheet or surface-treated metal sheet is at least 200%.

9. A resin laminated metal sheet for an easy-open can lid comprising a metal sheet or surface treated metal sheet laminated on one or both surfaces thereof with a crystalline saturated polyester resin film having a thickness of 10 to 100 μm, an elongation of at least 150%, a degree of crystallinity of not more than 10%, and a heat of fusion of crystalline of not less than 10 joules/g.

* * * * *